US005437402A

United States Patent [19]

Ring

[11] Patent Number: 5,437,402

[45] Date of Patent: Aug. 1, 1995

[54] CHILD CARRIER

[76] Inventor: Patrick S. Ring, 5725 Noble Ave., Van Nuys, Calif. 91411

[21] Appl. No.: 293,656

[22] Filed: Aug. 22, 1994

[51] Int. Cl.[6] ..... A47D 13/08

[52] U.S. Cl. ..... 224/159; 224/184; 224/901; 224/252; 128/882

[58] Field of Search ..... 224/159, 160, 161, 185, 224/184, 267, 269, 252, 206, 222; 2/300, 311, 312; 24/3 M, 302, 306; 297/4, 466; 128/876, 882

[56] References Cited

U.S. PATENT DOCUMENTS

| | | | |
|---|---|---|---|
| 2,059,563 | 11/1936 | Donoghue | 128/882 |
| 2,093,744 | 9/1937 | Tuckey | 128/882 |
| 3,698,608 | 10/1972 | Entwistle | 224/161 |
| 3,968,910 | 7/1976 | Dye et al. | 224/161 |
| 4,004,583 | 1/1977 | Johnson | 128/882 |
| 4,184,528 | 1/1980 | Kobilan | 224/222 |
| 4,416,403 | 11/1983 | Johnson | 224/159 |
| 4,422,455 | 12/1983 | Olsen | 128/882 |
| 4,484,700 | 11/1984 | Bush | 224/161 |
| 4,610,244 | 9/1986 | Hammond | 128/876 |
| 4,667,624 | 5/1987 | Smith | 224/184 |
| 4,728,553 | 3/1988 | Daniels | 297/466 |
| 4,993,612 | 2/1991 | Quimby, Sr. et al. | 224/159 |
| 5,071,047 | 12/1991 | Cordisco | 224/159 |
| 5,230,451 | 7/1993 | Onozawa | 224/252 |
| 5,256,119 | 10/1993 | Tudor | 128/882 |
| 5,263,618 | 11/1993 | Talavera | 224/206 |

*Primary Examiner*—Henry J. Recla
*Assistant Examiner*—Gregory M. Vidovich

[57] ABSTRACT

An apparatus for use in supporting a child being carried on the shoulders of the wearer comprises: two ankle wraps, each securely holding one of the child's ankles; a connecting element securely connected to the ankle wraps; and a mechanism for securely attaching the connecting element to the front of the waist of the wearer.

3 Claims, 1 Drawing Sheet

CHILD CARRIER

BACKGROUND OF THE INVENTION

1. Field of the Invention

The present invention relates to child carrier devices and more particularly to a device to be worn by an individual for use in supporting a child to be carried seated on the shoulders of the wearer.

2. Description of the Related Art

Devices for use in carrying children have heretofore been proposed in a variety of kinds. In one well-known arrangement, the child is arranged to be supported in a sling or harness worn on the back of an adult so that the child is carried papoose fashion. Such an arrangement is, however, suitable only for relatively small children and infants, and since the weight of the child is located entirely behind the back of the wearer, the load placed on the torso of the wearer is uncomfortable. Similarly, there are slings which may be worn on the front of the user.

Children have also traditionally been carried by adults in so-called piggy-back fashion, namely seated astride the adult's shoulders. This normally requires the adult to provide additional rearward support for the child to prevent it from falling, and devices have been proposed to provide such support for a child to be carried in this manner, so that the hands of the adult are left free. One such device, for example, is disclosed in U.S. Pat. No. 3,986,910 which comprises a backrest means arranged to provide rearward and lateral support for a child seated on the shoulders of an adult, the backrest means being interconnected with bracing means arranged to engage against the back of the adult.

U.S. Pat. No. 4,484,700, discloses a device which comprises a backrest for providing rearward and lateral support for the child, a bracing means for engagement against the rear of the torso of the wearer and a lever structure interconnecting the bracing means and the backrest. The structure extends forwardly and upwardly below the arms of the wearer and in front of the shoulders before passing behind the shoulders of the backrest. Thus, the structure utilizes the frontal shoulder region as a fulcrum to transfer a rearward load on the backrest to the bracing means.

SUMMARY OF THE INVENTION

The present invention is an apparatus for use in supporting a child being carried on the shoulders of the wearer. In a broad aspect, the present invention comprises two ankle wraps, each securely holding one of the child's ankles; a connecting element securely connected to the ankle wraps; and a mechanism for securely attaching the connecting element to the front of the waist of the wearer.

Unlike other previous cumbersome and complicated devices the present invention provides a simple, economical way to safely carry a child. The device may be easily stowed in the wearer's pockets, diaper carrying bag, etc.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figures 1, 2:
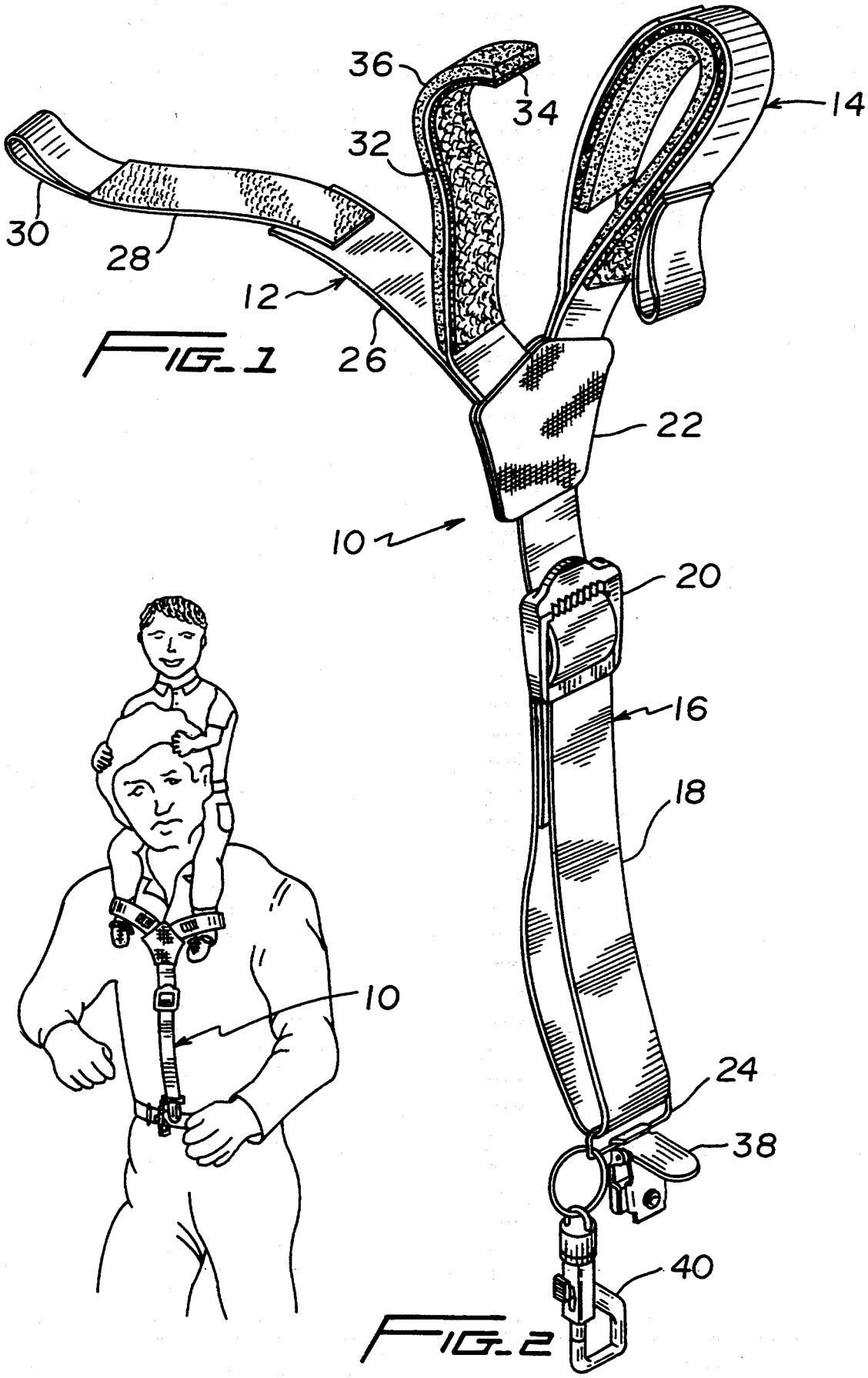
FIG. 1 is a perspective view of a preferred embodiment of the present invention.
FIG. 2 illustrates use of the present invention for a child being supported on the wearer's shoulders.

Referring now to the drawings and characters of reference marked thereon FIG. 1 illustrates a preferred embodiment of the present invention, designated generally as 10. Apparatus 10 includes a first ankle wrap 12, a second ankle wrap 14 and a connecting element 16 connected to the first and second ankle wraps. The connecting element 16 preferably includes a chest strap 18, an adjustment member 20 and a connecting piece 22. The upper end of chest strap 18 is fixed to and extends from the bottom of the connecting piece 22. The chest strap is preferably formed of a webbed nylon material. The chest strap 18 is drawn through adjustment member 20 and looped around a rigid ring 24 and then again through adjustment member 20. Thus, this connecting piece 22/adjustment member 20 combination provides accommodation of various wearer's heights and sizes.

Many other types of connecting elements 16 are within the purview of this invention. For example, instead of one chest strap 18, two chest straps may be used, in series, which may be connected by, for example, connectors of the type using two complimentary connectors, a male of which includes 2 pinchable prongs. The connecting piece 22 is preferred but optional. It provides a base for connecting chest strap 18 to the first and second ankle wraps 12, 14. The device can alternately be constructed by integrally connecting ankle wrap 12, ankle wrap 14 and chest strap 16 together.

Each ankle wrap 12,14 includes a first elongated strip 26 of resilient material terminating with a strip of fastener material 28 of the hook and loop type. Material 28 is commonly marketed under the trademark VELCRO ®. A loop 30 is at the end. Each ankle wrap 12, 14 includes a second elongated strip 32 of material with a complimentary strip 34 of VELCRO. A layer 36 of soft material such as Neoprene rubber is preferably provided for protecting the child's ankle. Proximal ends of the strips 26, 32 are fixed to the connecting element 22. Thus, in use, the complementary strips of VELCRO are attached to form a secure loop for containing the child's ankle, as shown by connected ankle wrap 14.

Means are provided for securely attaching the connecting element 22 to the waist of the user. Such means preferably includes a suspender clip 38, such as an oversized 1" stainless steel type. In addition to (or instead of) clip 38 a "key" clip may be utilized such as that shown by numeral designation 40.

Referring now to FIG. 2, when the child is desired to be carried on the wearer's shoulders, the child's ankles are secured by ankle wraps 12, 14 and the suspender clip 38 and/or key clip 40 is connected to the front of the wearer's belt, belt loop or trousers. As thus secured, the child cannot fall off the shoulders. As used herein, the term "front" is broadly defined as being generally in the front "semi circular" portion of the user's waist.

As noted above, unlike other previous cumbersome and complicated devices the present invention provides a simple, economical way to safely carry a child.

Obviously, many modifications and variations of the present invention are possible in light of the above teachings. It is, therefore, to be understood that within the scope of appended claims, the invention may be practiced otherwise than as specifically described.

What is claimed and desired to be secured by Letters Patent of the United States is:

1. A method for supporting a child on the shoulders of a person, comprising the steps of:

a) supporting a child on the shoulders of a person with the child's legs on opposite sides of the person's head;

b) securing the child's first ankle to a first ankle wrap;

c) securing the child's second ankle to a second ankle wrap, said first and second ankle wraps being connected to a first portion of a connecting element; and d) extending said connecting element down the front of said person and securely attaching a second portion of said connecting element to the front of the waist of said person.

2. The method of claim 1, wherein said steps of securing said child's ankles comprises securing said child's ankles with complementary strips of hook and loop type fastening material.

3. The method of claim 1, wherein said step of extending attaching said connecting element further comprises the step of adjusting said connecting element to accommodate said person's height and size, said connecting element comprising a chest strap.

* * * * *